United States Patent [19]

Biondi

[11] 4,261,309

[45] Apr. 14, 1981

[54] ELECTRIC STARTING SYSTEM FOR DIESEL CYCLE INTERNAL COMBUSTION ENGINES

[75] Inventor: Arturo Biondi, Turin, Italy

[73] Assignee: Fiat Auto S.p.A., Turin, Italy

[21] Appl. No.: 44,271

[22] Filed: May 29, 1979

[30] Foreign Application Priority Data

Jul. 14, 1978 [IT] Italy ..... 68674 A/78

[51] Int. Cl.[3] ..... F02N 17/00

[52] U.S. Cl. ..... 123/179 H; 123/145 A; 123/179 B

[58] Field of Search ..... 123/179 H, 179 B, 179 BG, 123/179 C, 179 R, 145 A

[56] References Cited

U.S. PATENT DOCUMENTS

| | | | |
|---|---|---|---|
| 4,075,998 | 2/1978 | Krauss et al. | 123/179 H |
| 4,088,109 | 5/1978 | Woodruff et al. | 123/179 H |
| 4,106,465 | 8/1978 | Bernhardt et al. | 123/179 H |

FOREIGN PATENT DOCUMENTS

| | | | |
|---|---|---|---|
| 2242421 | 4/1974 | Fed. Rep. of Germany | 123/179 H |
| 2847097 | 5/1979 | Fed. Rep. of Germany | 123/179 H |
| 1299589 | 12/1972 | United Kingdom | 123/179 H |

*Primary Examiner*—P. S. Lall

*Attorney, Agent, or Firm*—Sughrue, Rothwell, Mion, Zinn and Macpeak

[57] ABSTRACT

An electrical starting system for a Diesel engine has a manual selector switch which is moved momentarily to a preheating position to energize a relay which is then held energized by a relay switch from a battery D.C. source until the engine combustion chambers have been preheated sufficiently by preheating plugs to enable starting to be effected, indicated by the switching off of an indicator lamp. Starting can then be effected by the selector switch. If the preheating of the engine is incomplete the indicator lamp remains lit. A thermometric cut-out switch inhibits the preheating relay when the engine reaches a threshold temperature, avoiding wasteful operation of the preheating plugs with a hot engine.

2 Claims, 1 Drawing Figure

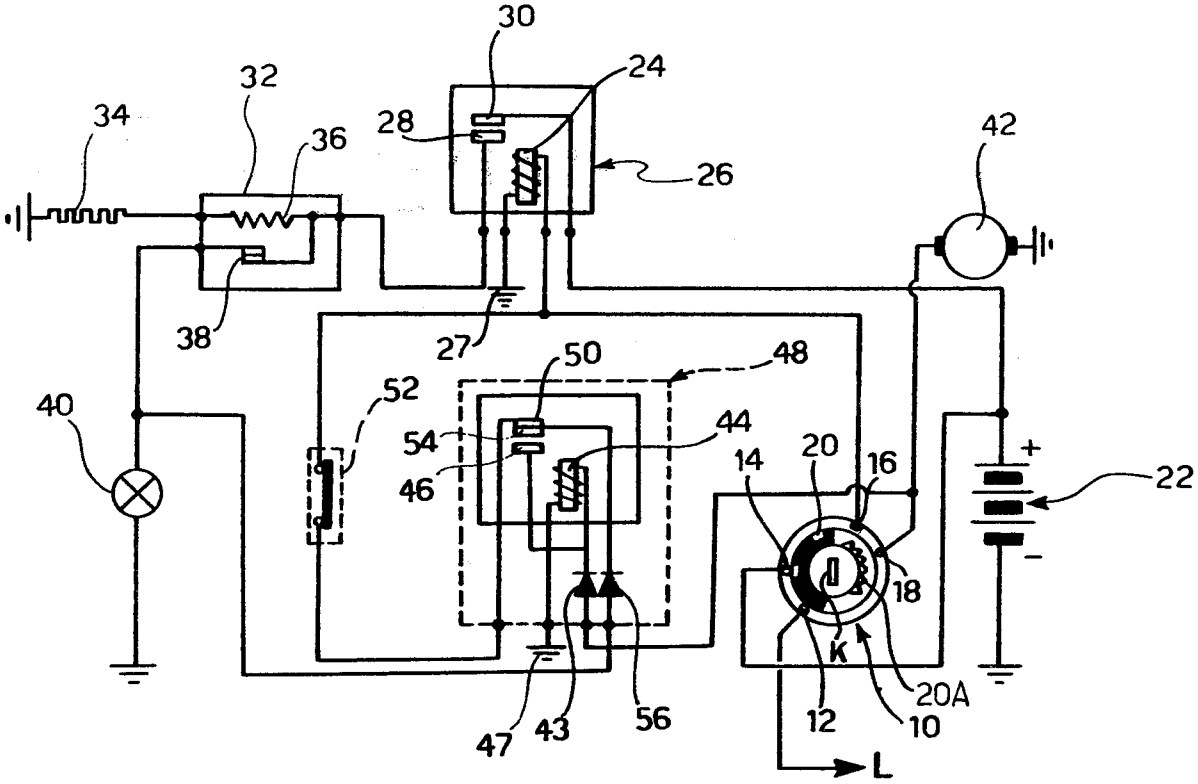
22
+
-
42
20A
10
18
16
20
12
L
K
14
48
44
56
26
24
50
43
30
27
47
28
54
46
52
36
32
38
34
40

ELECTRIC STARTING SYSTEM FOR DIESEL CYCLE INTERNAL COMBUSTION ENGINES

This invention relates to electrical starting systems for Diesel cycle internal combustion engines, especially motor vehicle engines.

More particularly, the invention is concerned with starting systems of the type having an electrical circuit supplied by a direct current source and including:

a manually rotatable electrical selector switch having a stable rest position, a stable running position, a first unstable position for preheating of the engine and a second unstable position for starting;

electrical preheating means situated close to each combustion chamber associated with each cylinder of the engine;

a relay having an excitation winding connected to a fixed contact of the selector switch corresponding to the first unstable position of the said switch, a movable contact connected to the positive pole of the direct current source, and a fixed contact connected to the said electrical preheating means;

visual indicator means connected to a thermostatic circuit breaker connected between the electrical preheating means and the fixed contact of the relay, and an electrical starter motor connected to the fixed contact of the selector switch corresponding to the second unstable position of the said switch.

In known starting systems of the aforesaid type it is necessary, during the preheating of the precombustion chambers of the cylinders, which precedes cold-starting of the engine, to move the selector switch manually into the preheating position by means of a control key and to hold the key in this position until the end of the preheating stage against the action of resilient return means acting upon the movable contact of the selector switch. This is not generally convenient since the torque which normally has to be exerted on the control key of the selector switch to overcome the reaction of the resilient return means is of the order of 2.5–4 kg/cm. Moreover, the preheating stage may last for more than 30 seconds with atmospheric temperatures around 0° C.

It has been proposed to avoid this problem by effecting the preheating stage automatically for a timed interval upon momentary closure of the appropriate contact of the selector switch, but using a relatively expensive electronic control circuit.

The object of the present invention is to provide an electrical starting system for Diesel cycle internal combustion engines in which the aforesaid problem can be overcome with a simple and economical circuit.

With this object in view the present invention provides an electrical starting system of the type referred to, characterised in that the system further comprises:

a relay switch having an excitation winding, a first fixed contact connected to a fixed contact of the selector switch corresponding its second unstable position a second fixed contact connected to the excitation winding of the relay, and a movable contact interposed between said first and second fixed contacts and connected through the thermostatic circuit breaker to the contacts of the relay, and a thermometric switch responsive to the temperature of the engine, or the engine coolant, interposed between the excitation winding of the said relay and the said second fixed contact of the relay switch.

The invention will now be described by way of non-limiting example, with reference to the accompanying drawing, which is a circuit diagram of an electrical starting system according to one embodiment of the invention.

The illustrated starting system includes a manually operable selector switch 10 of the type normally employed for starting diesel cycle internal combustion engines for motor vehicles. The selector switch 10 has a first, a second a third and a fourth fixed contact 12, 14, 16 and 18 respectively, and a manually rotatable contact segment 20, movable by manual rotation of an inserted key K.

The rotatable contact segment 20 may be moved by the key K between the two stable positions, namely a stable rest position, shown in the drawing, in which the contact segment 20 is out of contact with the fixed contact 14, and a stable running position in which the second fixed contact 14, connected to the positive pole of a direct supply source comprising a battery 22, is connected to the first fixed contact 12 which in turn is connected to the consumer loads of the vehicle for normal running. In addition, the selector switch 10 is movable into a first unstable position for preheating, in which the contact segment 20 connects the fixed contact 14 electrically to the third contact 16, and a second unstable position for starting in which the contact segment 20 connects the fixed contact to the fourth contact 18. In the first and second unstable positions of the selector switch 10, the rotatable contact segment 20 is acted upon by resilient return spring, indicated diagrammatically by 20A, effective to return the contact segment 20 to the stable running position upon release of the manually operable key K.

The third fixed contact 16 is electrically connected to one end of the excitation winding 24 of a relay 26, the other end of the excitation winding 24 being grounded. The excitation winding 24 cooperates with a fixed contact 28 and a relatively movable contact 30, the contacts 28, 30 being normally open. The movable contact 30 is connected to the positive pole of the battery 22, whilst the fixed contact 28 is connected, through a heating resistance 36 of a thermostatic circuit breaker 32, to respective preheating plugs 34 located in proximity to the respective combustion chambers (not shown) of the cylinders of the engine, one only of the plugs 34 being shown.

The heating resistance 36 of the thermostatic circuit breaker 32 is associated with a normally closed bimetallic switch 38 one contact of which is connected to the fixed contact 28 of the relay 26 and the other contact of which is connected to an indicator lamp 40.

The fourth fixed contact 18 of the selector switch 10 is connected to an electrical starter motor 42, of the type known per se. In addition the fixed contact 18 is connected, through a diode 43, to one end of the excitation winding 44, and to a first fixed contact 46, of a relay switch 48, the other end of the excitation winding 44 being grounded. The relay switch 48 has a second fixed contact 50 connected, through a normally closed thermometric switch 52, to the excitation winding 24 of the relay 26, and a movable contact 54 which is normally engaged with the fixed contact 50. The movable contact 54 is connected through a diode 56 to the fixed contact 28 of the relay 26, through the normally closed switch 38 of the thermostatic circuit breaker 32.

The thermometric switch 52, which may be of the bimetallic type with normally closed contacts, is sensitive to the engine coolant temperature and is calibrated so as to open its contacts at a coolant temperature of about 65° C.

The operation of the illustrated starter system according to the invention will now be described.

In order to effect preheating of the engine combustion chambers for cold-starting of the engine, the movable contact segment 20 of the selector switch 10 is moved momentarily into its first unstable position and subsequently released. The momentary supply of current from the battery 22 through the second and third contacts 14, 16 to the excitation winding 24 of the relay 26 causes momentary closure of the contacts 28, 30. This causes electrical current to be delivered from the battery 22, through the heating resistance 36, to the preheating plugs 34. Current is simultaneously supplied through the bimetallic switch 38 to the indicator lamp 40, and through the contacts 54, 50 of the relay switch 48 and the thermometric switch 52 to the excitation winding 24 of the relay 26, maintaining the relay 26 energised, and contacts 28, 30 closed, even after the selector switch 10 has been released, for a time necessary to complete the automatic preheating cycle.

When the temperature of the cooling water of the engine exceeds a predetermined threshold value, the contacts of the thermometric switch 52 open and interrupt the supply to the winding 24 of the relay 26 which is de-energised; upon de-energisation of the relay 26 the contacts 28 and 30 open, switching off the indicator lamp 40 and inhibiting the automatic preheating cycle, which is not then necessary.

The rotatable contact segment 20 of the selector switch 10 is next moved into its second unstable position for starting, passing through the first unstable position. During this operation the preheating plugs 34 are energised as described above, and as a result of the bridging of the second fixed contact 14 and the fourth fixed contact 18 of the selector switch 10 by the contact segment 20 the starter motor 42 and the excitation winding 44 of the relay switch 48 are energised simultaneously. If the preceding preheating operation has been correctly completed, the indicator lamp 40 remains extinguished, while if the preheating operation is incomplete, the indicator lamp 40 remains on throughout the starting phase, and, through the excitation of the winding 44, the relay swtch 48 causes the movable contact 54 to close onto the fixed contact 46, interrupting the supply to the preheating plugs 34, and contacts 46, 54 being maintained closed by the excitation of the winding 44.

When the engine has started the key K of the selector switch 10 is released, allowing the contact segment 20 of the selector switch 10 to return to its stable running position under the influence of the return spring 20A and disconnecting the preheating plugs 34 from the battery 22.

From the preceding description it will be apparent that the device according to the invention makes it possible to effect automatic preheating of the engine simply and economically, while at the same time making it possible to effect such preheating, in the event of failure of the relay switch 48, by maintaining the rotatable contact segment 20 of the selector switch 10 in its first unstable position manually.

The system further ensures that the electrical supply is cut off from the preheating plugs 34 when the engine is running and by virtue of the thermometric switch 52 avoids the operation of the preheating plugs 34 with a hot engine, thereby ensuring a long working life of the preheating plugs.

The system according to the invention also makes it possible to indicate effectively any breakdown of the preheating plugs 34. Thus in the event of non-operation of one or more of the preheating plugs 34, the indicator lamp 40 is lit for a period of time greater than the corresponding to normal operation of the plugs.

What is claimed is:

1. Electrical starting system for Diesel cycle internal combustion engines of the type having combustion chambers associated with its respective cylinders, said starting system having an electrical circuit for connection to a direct current source such as a battery and including:

a manually rotatable electrical selector switch having a movable contact and fixed contacts selectively engageable by the movable contact and defining a stable rest position, a stable running position, a first unstable position for preheating of the engine and a second unstable position for starting;

electrical preheating means situated close to the respective combustion chamber associated with each cylinder of the engine;

a first relay having an excitation winding connected to the fixed contact of the selector switch corresponding to the first unstable position of said switch, said first relay having associated contacts through which the positive pole of the direct current source is connected to the said electrical preheating means;

a thermostatic circuit breaker;

a visual indicator means connected through said thermostatic circuit breaker to said first relay contacts, and an electrical starter motor connected to the fixed contact of the selector switch corresponding to the second unstable position of the said switch, wherein the improvement consists in said system further comprising:

a second relay having an excitation winding, a first fixed contact connected to the fixed contact of the selector switch corresponding to the second unstable position of the latter, a second fixed contact connected to the excitation winding of said first relay, and a movable contact interposed between said first and second fixed contacts and connected through the thermostatic circuit breaker to the contacts of said first relay, and a thermometric switch responsive to the temperature of the engine and interposed between the excitation winding of said first relay and said second fixed contact of said second relay to prevent energization of said first relay when the engine temperature exceeds a predetermined threshold value, said first fixed contact and the excitation winding of said second relay are both connected through a diode to the said fixed contact of the selector switch corresponding to the second unstable position of the latter and the movable contact of said second relay is connected through a further diode to the thermostatic circuit breaker.

2. Starting system as in claim 1, wherein the thermostatic circuit breaker comprises an electrical heating resistance connected at one end to one of the contacts of said first relay and at the other end to said electrical preheating means, and associated normally closed bimetallic contacts connected to the said one of the contacts of said first relay and to the said visual indicator means respectively.

* * * * *